US009932714B2

(12) United States Patent
Graham et al.

(10) Patent No.: US 9,932,714 B2
(45) Date of Patent: Apr. 3, 2018

(54) SYSTEMS, APPARATUSES AND METHODS FOR MATERIAL FLOW CONTROL FOR WIDE-WIDTH PAVING

(71) Applicant: Caterpillar Paving Products Inc., Brooklyn Park, MN (US)

(72) Inventors: Luke E. Graham, Clinton, MT (US); Toby A. Frelich, Saint Michael, MN (US); Rick L. Mings, Oak Grove, MN (US); Ryan T. Thiesse, Otsego, MN (US)

(73) Assignee: Caterpillar Paving Products Inc., Brooklyn Park, MN (US)

( * ) Notice: Subject to any disclaimer, the term of this patent is extended or adjusted under 35 U.S.C. 154(b) by 45 days.

(21) Appl. No.: 15/139,870

(22) Filed: Apr. 27, 2016

(65) Prior Publication Data

US 2017/0314215 A1 Nov. 2, 2017

(51) Int. Cl.
*E01C 19/48* (2006.01)

(52) U.S. Cl.
CPC ..... *E01C 19/48* (2013.01); *E01C 2301/16* (2013.01)

(58) Field of Classification Search
CPC ..... E01C 19/48; E01C 2301/16
USPC ..... 404/84.05–84.5, 101, 105, 118
See application file for complete search history.

(56) References Cited

U.S. PATENT DOCUMENTS 5,201,604 A * 4/1993 Ferguson ..... E01C 19/008 404/110
5,258,961 A 11/1993 Sehr et al.
5,356,238 A * 10/1994 Musil ..... E01C 19/008 404/101
5,401,115 A 3/1995 Musil et al.
5,484,226 A * 1/1996 Emerson ..... E01C 19/48 404/108
5,529,434 A * 6/1996 Swisher, Jr. ..... E01C 19/48 404/108
5,575,583 A * 11/1996 Grembowicz ..... E01C 19/48 404/72
7,470,082 B2 12/2008 Lloyd
8,930,092 B2 1/2015 Minich
8,979,423 B2 3/2015 Smieja
9,004,811 B2 4/2015 Mings et al.
2006/0045620 A1* 3/2006 Olson ..... E01C 19/48 404/84.1
2015/0166274 A1 6/2015 Swearingen
(Continued)

OTHER PUBLICATIONS

Leica GradeSmart, *Universtal Control System for all Grading Machines*, Leica Geosytems, 206 (4 pages), available at http://w3.leica-geosystems.com/downloads123/zz/machine/mc1200/brocures/GradeSmart_brochure_en.pdf.

*Primary Examiner* — Raymond W Addie
(74) *Attorney, Agent, or Firm* — Oblon, McClelland, Maier & Neustadt

(57) ABSTRACT

A paving machine for wide-width paving includes a conveyor system, an auger system disposed adjacent to the conveyor system, a screed adjacent to the auger system, and sensing circuitry configured to sense paving material height at one or more of an entrance to the conveyor system and a front side of the auger system to sense or detect underflow or overflow conditions of the paving material. The sensed heights are communicated to control circuitry of the paving machine, through signals from the sensing circuitry, and control circuitry controls rate of movement of one or more of the conveyor system and the auger system.

20 Claims, 6 Drawing Sheets

(56) References Cited

U.S. PATENT DOCUMENTS

| | | | |
|---|---|---|---|
| 2015/0247294 | A1 | 9/2015 | Weiler et al. |
| 2015/0267361 | A1 | 9/2015 | Horn et al. |

* cited by examiner

SYSTEMS, APPARATUSES AND METHODS FOR MATERIAL FLOW CONTROL FOR WIDE-WIDTH PAVING

TECHNICAL FIELD

The present disclosure generally relates to paving systems and apparatuses and methods thereof, and more particularly to systems, apparatuses and methods for material flow control for wide-width paving.

BACKGROUND

Generally speaking, in North America typically only one lane is paved at a time. However, it is possible to pave widths up to 16 ft. or 20 ft, depending upon whether the initial paving width is 8 ft. or 10 ft, respectively. Thus, a screed can be extended from 8 ft. to 16 ft. or from 10 ft. to 20 ft., for instance, by hydraulically extending an extendable screed wing on each side of a main screed (i.e., left and right extensions) via a carriage configured to extend and retract the screed extensions. Outside of North America, sometimes four lanes at a time are paved. As such, the screed can extend up to 44 ft., for instance. For such length of screed (i.e., paving width), the screed extensions may be bolted together, either rear mounted (i.e., mounted to a rear of the main screed), front mounted (i.e., mounted to a front of the main screed), or fixed directly outward from the main screed. In extended-screed cases such as those described above, multiple auger segments, provided in front of the screed, can extend linearly outward from opposite sides of a generally central deposit site where the paving material is deposited.

Uneven or inconsistent distribution of paving material (e.g., asphalt concrete) in front of the screed, particularly in the context of wide-width paving, can change how the screed "floats" on top of the matte (including screed height and/or angle) and can cause surface matte defects, such as holes, bumps, divots and texture imperfections, including an unsuitable open texture or tight texture. For example, uneven or inconsistent distribution of paving material can be a result of paving material underflow and overflow conditions, that is, too little or too much paving material supplied in front of the screed by the auger(s) or segmented auger sets, respectively. Generally speaking, an underflow condition means not enough paving material is provided and a void in the paving material can be created at the screed, for instance, which means the screed can fall and create a divot in the road surface, and an overflow condition means too much paving material is provided, which can cause the screed to climb and create a bump or high spot on the surface of the road. Thus, overflow or underflow conditions can affect the ability of the screed to produce a surface with a high-quality matte (e.g., a flat, smooth matte).

U.S. Pat. No. 8,979,423 describes a method and apparatus for controlling material feed for asphalt pavers. The material feed system can include a screed, a feeder conveyor and a spreader auger. A sensor can measure a material volume and transmit this information to an Electronic Control Module (ECM). This information may be used as target material volume, which the ECM may use to calculate a corresponding conveyor speed and auger speed. The sensor monitors the material volume as paving commences, and the ECM maintains the initial calibrated target size by adjusting the auger and conveyor rotational speeds.

SUMMARY OF THE DISCLOSURE

In an aspect of the present disclosure, a movable paving system for wide-width paving is provided. The paving system includes a conveyor system having a first end to receive a paving material from a hopper and a second end opposite to the first end to output the paving material received at the first end. The conveyor system has a first conveyor and a second conveyor parallel to the first conveyor, the first conveyor and the second conveyor being independently controllable. The paving system further includes an auger system arranged adjacent the second end of the conveyor system to receive the paving material from the conveyor system at a middle portion of the auger system. The auger system includes a first set of augers extending in a first direction from the middle portion of the auger system, and a second set of augers extending in a second direction opposite the first direction from the middle portion of the auger system, the first set of augers being controllable independently from the second set of augers. The paving system further includes a screed having a front side facing the auger system and a length at least as long as a total length of the auger system in the first and second directions, the length of the screed being greater than or equal to two times of a retracted width of the screed, a first mainframe extension in front of the auger system that extends in the first direction, and a second mainframe extension in front of the auger system that extends in the second direction. The paving system further includes sensing circuitry arranged at an entrance of a tunnel of the conveyor system, at the first end of the conveyor system, the sensing circuitry being configured to sense a height of the paving material on the conveyor system received from the hopper. The paving system further includes a first set of three or more sensors, different from the sensing circuitry arranged at the entrance of the tunnel of the conveyor system. The first set of three or more sensors are arranged in spaced relationship from each other, and each sensor is configured to sense a height of the paving material at the front side of the auger system at a corresponding different portion of a left side of the auger system. The paving system further includes a second set of three or more sensors, different from the sensing circuitry arranged at the entrance of the tunnel of the conveyor system. The second set of three or more sensors are arranged in spaced relationship from each other, and each of sensors is configured to sense a height of the paving material at the front side of the auger system at a corresponding different portion of a right side of the auger system. The paving system further includes control circuitry configured to control rate of movement of one or more of the first conveyor and the second conveyor based on a signal received from the sensing circuitry at the entrance of the tunnel of the conveyor system. The control circuitry is further configured to control rate of movement of the first conveyor based on signals from the first set of three or more sensors, control rate of movement of the first set of augers based on the signals from the first set of three or more sensors, control rate of movement of the second conveyor based on signals from the second set of three or more sensors, and control rate of movement of the second set of augers based on the signals from the second set of three or more sensors.

In another aspect of the present disclosure, a movable paving machine is provided. The movable paving machine includes a conveyor having a first end to receive paving material and a second end opposite the first end to output the paving material received at the first end. The movable paving machine further includes an auger system disposed adjacent the second end of the conveyor to receive the paving material from the conveyor at a deposit site and having a plurality of augers extending outward in a line from the deposit site. The movable paving machine further includes a first mainframe extension extending outward in a first direction, a second mainframe extension extending outward in a second direction opposite the first direction, and a plurality of sensors configured to sense paving material height at different locations along a front side of the auger system, one of the sensors being configured to detect paving material height at a location at the front side of the auger system between the deposit site and an end of the auger system opposite the deposit site. The paving machine further includes control circuitry configured to receive signals from the plurality of sensors indicative of the detected paving material heights, to increase or decrease a rate or speed of movement of one or more conveying portions of the conveyor and the plurality of augers of the auger system, responsive to a signal from said one of the sensors indicating an underflow condition or an overflow condition of the paving material, respectively, at the location at the front side of the auger system between the deposit site and end of the auger system opposite the deposit site.

In another aspect of the present disclosure, a method of wide-width paving is provided. The method includes receiving, at a controller, signals from a plurality of sensors representing detected pre-set paving material height conditions at different, spaced-apart locations along an entire front side of an auger system, including a first composite signal of representing a first pre-set paving material height condition at the front of the an auger system at a first position on a first side of a deposit site of the paving material from a conveyor system, between the deposit site and a first end of the auger system, and a second composite signal representing a second pre-set paving material height condition at the front of the auger system at a second position on a second side of the deposit site opposite the first side, between the deposit site and a second end of the auger system. The method further includes selectively increasing or decreasing, using the controller, a rate of movement of a first set of augers of the auger system on the first side of the deposit site responsive to the first composite signal representing the first pre-set paving material height condition of either an underflow or overflow condition; and selectively increasing or decreasing, using the controller, a rate of movement of a second set of augers of the auger system on the second side of the deposit site responsive to the second composite signal representing the second pre-set paving material height condition of either an underflow or overflow condition.

Other features and aspects of this disclosure will be apparent from the following description and the accompanying drawings.

BRIEF DESCRIPTION OF THE DRAWINGS

The accompanying drawings, which are incorporated in and constitute a part of the specification, are illustrative of one or more embodiments and, together with the description, explain the embodiments. The accompanying drawings have not necessarily been drawn to scale. Further, any values or dimensions in the accompanying drawings are for illustration purposes only and may or may not represent actual or preferred values or dimensions. Where applicable, some or all select features may not be illustrated to assist in the description and understanding of underlying features.

DETAILED DESCRIPTION

Figure 1:
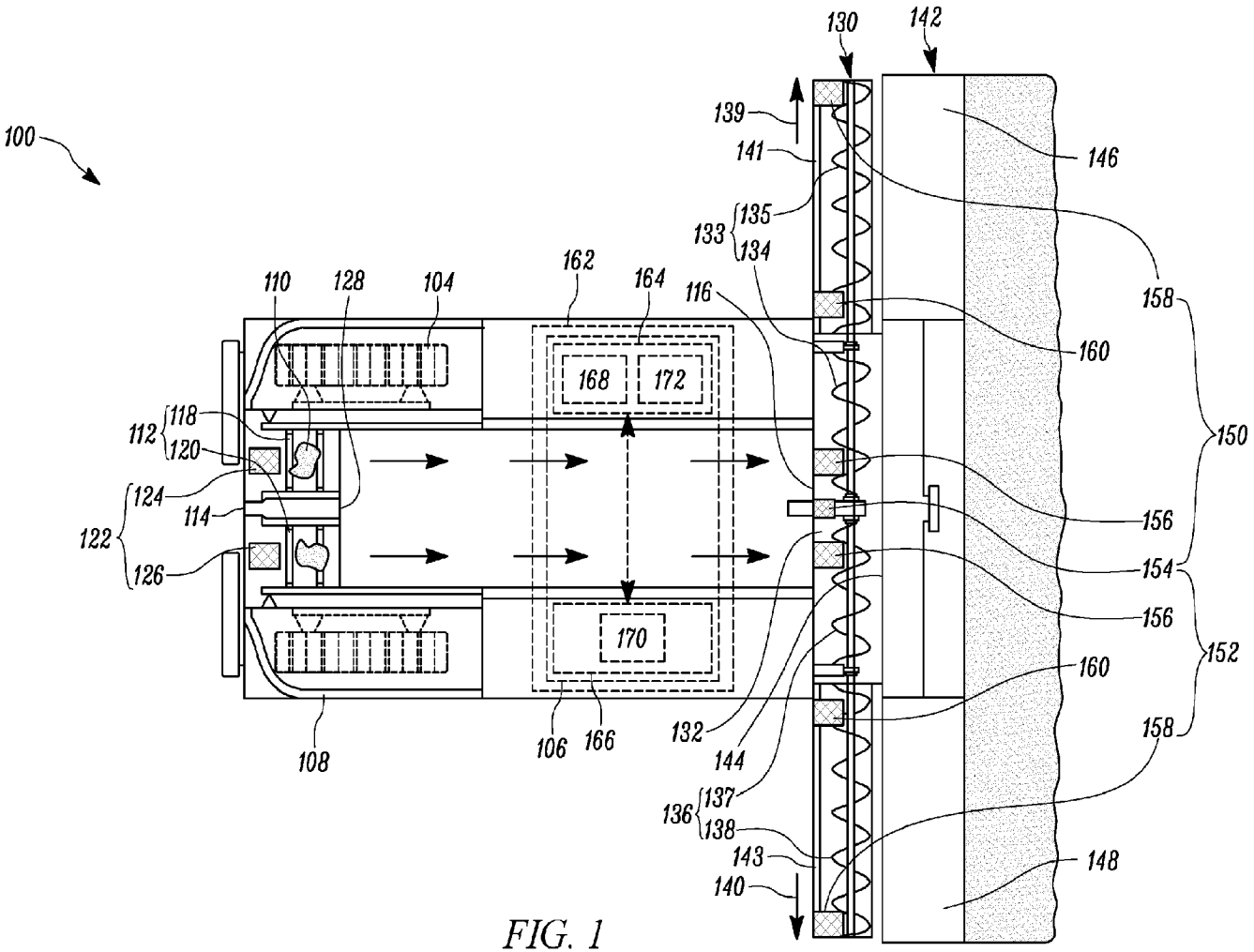
FIG. 1 is a planar diagrammatic representation of a paving machine or movable paving system, according to one or more embodiments of the present disclosure.

The description set forth below in connection with the appended drawings is intended as a description of various embodiments of the described subject matter and is not necessarily intended to represent the only embodiment(s). In certain instances, the description includes specific details for the purpose of providing an understanding of the described subject matter. However, it will be apparent to those skilled in the art that embodiments may be practiced without these specific details. In some instances, well-known structures and components may be shown in block diagram form in order to avoid obscuring the concepts of the described subject matter. Wherever possible, the same reference numbers will be used throughout the drawings to refer to the same or the like parts.

Any reference in the specification to "one embodiment" or "an embodiment" means that a particular feature, structure, characteristic, operation, or function described in connection with an embodiment is included in at least one embodiment. Thus, any appearance of the phrases "in one embodiment" or "in an embodiment" in the specification is not necessarily referring to the same embodiment. Further, the particular features, structures, characteristics, operations, or functions may be combined in any suitable manner in one or more embodiments, and it is intended that embodiments of the described subject matter can and do cover modifications and variations of the described embodiments.

It must also be noted that, as used in the specification, appended claims and abstract, the singular forms "a," "an," and "the" include plural referents unless the context clearly dictates otherwise. That is, unless clearly specified otherwise, as used herein the words "a" and "an" and the like carry the meaning of "one or more." Additionally, it is to be understood that terms such as "left," "right," "top," "bottom," "front," "rear," "side," "height," "length," "width," "upper," "lower," "interior," "exterior," "inner," "outer," and the like that may be used herein, merely describe points of reference and do not necessarily limit embodiments of the described subject matter to any particular orientation or configuration. Furthermore, terms such as "first," "second," "third," etc. merely identify one of a number of portions, components, points of reference, operations and/or functions as described herein, and likewise do not necessarily limit embodiments of the described subject matter to any particular configuration or orientation.

Generally speaking, the disclosed subject matter relates to systems, methods, and apparatuses to more quickly and accurately detect and correct paving material flow or delivery issues or potential flow or delivery issues, such as underflow and overflow conditions, to prevent or reduce uneven or inconsistent distribution of paving material by an auger system, or portion thereof, to a front of a screed and/or to prevent or correct paving material flow issues or potential issues when or prior to initial deposit of the paving material from a conveyor system, or portion thereof, to the auger system, or portion thereof.

According to embodiments of the disclosure, sensors can be arranged in spaced-apart relationship with each other to essentially sense paving material height along an entire length of an auger system, particularly in the context of an extended or "wide-width" paving situation, to automatically identify and correct with accuracy overflow and/or underflow conditions as early as possible, without "overcorrecting" the amount of paving material supplied to the auger system responsive to the overflow or underflow condition.

Embodiments of the disclosed subject matter can additionally or alternatively electronically detect or sense whether the amount of paving material supplied to an entryway of a conveyor system (e.g., an entryway of a tunnel of the conveyor system) is within tolerances, out of tolerance (e.g., in an underflow or overflow condition), or approaching an out-of-tolerance condition. Information can be provided to a paving machine operator to identify one or more of the detected paving material flow conditions. Optionally, motion of the paving machine or portion thereof (e.g., conveyor system) may be changed, for instance, stopped, responsive to a particular one or more of the detected paving material flow conditions.

Turning now to the figures, FIG. 1 illustrates a planar diagrammatic representation of a paving machine or movable paving system 100, according to one or more embodiments of the present disclosure. The paving machine 100 may be implemented with or implement a method or methods according to the present disclosure. In an embodiment, the paving machine 100 may include, but not limited to, an asphalt paving machine. In alternative examples, the paving machine 100 may be any other type of paving machine adapted to carry out paving of material other than asphalt, such as concrete. Further, although FIG. 1 illustrates a particularly configuration or layout of paving machine or movable paving system 100, embodiments of the disclosed subject matter are not so limited, and can be of different configurations or layouts.

As illustrated in FIG. 1, the paving machine 100 can include drive tracks 104 to move the paving machine 100 along a roadway (not shown) or a base course (not shown) on which a paving process will be carried out. The drive tracks 104 may be powered by an internal combustion engine (not shown) housed within an engine compartment 106. The paving machine 100 can further include a hopper 108, which may be disposed generally at a front portion or section of the paving machine 100. The hopper 108 is adapted to receive paving material 110 from a dump truck (not shown), for instance, or any other machine or a carrier which can provide the paving material 110 to the hopper 108. The paving material 110, after being provided to the hopper 108, can be transported or moved to a conveyor system 112, which can move the paving material 110, for example, rearward toward an exit of the conveyor system 112 for deposit at a deposit site or area.

More particularly, the conveyor system 112 transports the paving material 110 from a first end 114 of the conveyor system 112 to a second end 116 of the conveyor system 112. The first end 114 of the conveyor system 112 is adapted to receive the paving material 110 from the hopper 108, and the second end 116 of the conveyor system 112 is adapted to output the paving material 110.

The conveyor system 112 may include one or more conveyors, which may be arranged in slatted configuration to hold the paving material 110 during transportation along the conveyor system 112. In FIG. 1, the conveyor system 112 includes a first conveyor 118 and a second conveyor 120 disposed parallel to the first conveyor 118. Parameters related to the conveyor system 112 such as length, use of single or multiple conveyors, orientation of conveyor(s), etc. may vary without any limitation. The first conveyor 118 and the second conveyor 120 are adapted to be operated in a controlled manner and can be controlled independently from one another by an operator of the paving machine 100 and/or automatically using control circuitry. The first conveyor 118 and the second conveyor 120 may be or include belts and/or chains as a means by which to move paving material 110.

The paving machine 100 can further include sensing circuitry 122 disposed at an entrance of a tunnel 128 of the conveyor system 112 running under or below a designated paving machine operator station 162, as illustrated in FIG. 1, or, alternatively, at the first end 114 of the conveyor system 112. The sensing circuitry 122 is configured to sense paving material height of the paving material 110 on the conveyor system 112 at a predetermined location or location, for instance, at the entrance at tunnel 128 or at a first end of the 114 of the conveyor system, wherever paving material is first designated to have been received by the conveyor system 112. For example, in one or more embodiments, the sensing circuitry 122 can include a first sensor 124 and a second sensor 126 disposed to sense paving material height at predetermined locations along the first conveyor 118 and the second conveyor 120, respectively.

Thus, the sensing circuitry can detect or sense whether the amount of paving material supplied from the hopper to an entryway of the conveyor system 122 is within tolerances, out of tolerance (e.g., in an underflow or overflow condition), or approaching an out-of-tolerance condition. Alternatively, signals from the sensing circuitry 122 regarding sensed or detected paving material height can be provided to a paving machine control system 102, which, in turn, can determine whether the amount of paving material supplied from the hopper to an entryway of the conveyor system 122 is within tolerances, out of tolerance (e.g., in an underflow or overflow condition), or approaching an out-of-tolerance condition. Information regarding whether the sensed or detected paving material height is within tolerances, out of tolerance (e.g., in an underflow or overflow condition), or approaching an out-of-tolerance condition can be provided to a control panel 164 of the operator station 162 to identify or indicate one or more of the detected paving material flow conditions. Optionally, motion of the paving machine may be stopped, manually or automatically, responsive to a particular one or more of the detected paving material flow conditions, such as the paving material height being out of tolerance at an entryway of the conveyor system 122.

Additional remedial actions may be taken for an out of tolerance condition or anticipated out of tolerance condition. For example, if an underflow condition or expected underflow condition is identified, the operator can stop movement of the paving machine, or the movement can be stopped automatically, so the hopper 108 can be re-filled to supply the conveyor system 112 with more paving material 110 in an effort to prevent a void from being created at an auger system and screed.

The conveyor system 112 may move the paving material 110 rearward through the tunnel 128 to a spreading or a distribution mechanism (not shown in figures) of the paving machine 100. The distribution mechanism may be configured to distribute the paving material 110 onto the road construction surface. One skilled in the art will appreciate that the distribution mechanism may include a laterally extending trough (not shown) to receive the paving material 110 from the conveyor system 112. The trough is provided in front of a screed 142, and can accommodate an auger system 130 configured to spread the paving material 110 received from the conveyor system 112 outwardly in opposite directions from a paving material dump or deposit site or area in the trough. Further, the trough may be defined by a first mainframe extension 141 and a second mainframe extension 143.

Generally speaking, the auger system 130 is arranged at the second end 116 of the conveyor system 112, and is configured to receive the paving material 110 from the conveyor system 112, at a middle portion 132 of the auger system 130, which may be referred to herein as paving material dump or deposit site or area, and spread the paving material outward from the middle portion toward and to respective ends of the auger system 130. In this regard, the auger system 130 can include a first set of augers 133 extending in a first direction 139 from the center or middle portion 132 of the auger system 130, and a second set of augers 136 extending in a second direction 140 opposite the first direction 139. Each of the first and second sets of augers 133, 136 can include a plurality of distinct auger segments, two or more, for instance. For example, FIG. 1 illustrates the first set of augers 133 having first auger segment 134 and second auger segment 135. Likewise, FIG. 1 illustrates the second set of augers 136 having third auger segment 137 and fourth auger segment 138.

The first set of augers 133 and the second set of augers 136 are adapted to be independently controlled or operated, for instance, based on control signals from the paving machine control system 102. That is, the first set of augers 133 may be operated at a same or different speed as compared to the speed at which the second set of augers 136 is operated. Likewise, the first set of augers 133 may be stopped without stopping the second set of augers 136 and vice versa.

The paving machine 100 further includes the screed 142, which may be configured substantially permanently or temporarily for wide-width paving, positioned rearward of the auger system 130, first mainframe extension 141, and second mainframe extension 143, and a plurality of sensors arranged in spaced apart relationship with each other generally at a front side of the auger system 130, for instance, some of which be coupled to the first and second mainframe extensions 141, 143, to sense paving material height at various locations along the auger system 130, for instance, at a front side and/or a central axis of the auger system 130. Generally speaking, the screed 142 flattens the paving material at the front side 144 thereof to produce a resultant post-screed pavement material area 174, which may be further processed by other paving machinery.

The plurality of sensors includes a first set of sensors 150, which may be grouped from the center or middle portion 132 of the auger system 130 to a first end of the auger system 130, for instance, adjacent a first end of the screed 142, and a second set of sensors 152, which may be grouped from the center or middle portion 132 the auger system 130 to a second end of the auger system 130, for instance, adjacent a second end of the screed 142 opposite the first end of the screed 142. Alternatively, the first and second sets of sensors 150, 152 may not be grouped with an optional first sensor 154 arranged at or adjacent the center or middle portion 132 of the auger system 130 that senses a height of the paving material 110 received from the conveyor system 112 at the center or middle portion 132 of the auger system 130.

Each of the first set of sensors 150 and the second set of sensors 152 can include a plurality of sensors grouped with or without the optional first sensor 154 arranged at or adjacent the center or middle portion 132 of the auger system 130 to sense a height of the paving material 110 received from the conveyor system 112 at the center or middle portion 132 of the auger system 130. FIG. 1, for instance, illustrates three sensors associated with a first side of the auger system 130 (and consequently a first side 146 of the screed 142) and three sensors associated with a second side of the auger system 130 (and consequently a second side 148 of the screed 142), respective second sensors 156, third sensors 158, and fourth sensors 160. FIG. 1 also illustrates first sensor 154 being grouped with the first and second sets of sensors 150, 152. Thus, in the example, the first set of sensors 150 can be interpreted as including the first sensor 154, and the second sensor 156, the third sensor 158, and the fourth sensor 160 associated with the first side of the auger system 130. Likewise, the second set of sensors 152 can be interpreted as including the first sensor 154, and the second sensor 156, the third sensor 158, and the fourth sensor 160 associated with the second side of the auger system 130. Of course, alternatively, the first and second sets of sensors 150, 152 may be interpreted as excluding the first sensor 154. Regarding the fourth sensor 160, though FIG. 1 shows such sensors arranged adjacent the second auger segment 135 and the fourth auger segment 138, on the first mainframe extension 141 and the second mainframe extension 143, respectively, the fourth sensor 160 may alternatively be provided adjacent the first auger segment 134 and the third auger segment 137, at outer-most portions thereof, for instance.

Thus, the first sensor 154 can sense a height of the paving material 110 where the paving material 110 is received from the conveyor system 112. Also, the third sensors 158, which may be disposed on the first and second mainframe extensions 141, 143, and at one or both ends of the auger system 130, are configured to sense paving material directly in front of the second auger segment 135 and the fourth auger segment 138 and/or at the central axle of the second auger segment 135 and the fourth auger segment 138. Each of the fourth sensors 160, which may be disposed directly over the center or middle portion 132 of the auger system 130 and between the second sensor 156 and the third sensor 158, is configured to sense the height of the paving material 110 at a location between the sensing location of the first sensor 154 and the sensing location of the third sensor 158.

According to one or more embodiments of the disclosed subject matter, each auger segment of the auger system 130 can have associated therewith two or more sensors to sense paving material height at corresponding locations along the auger system 130. For example, sensors to sense paving material height may be provided in association with inner-most and out-most portions of each auger segment (i.e., at first and second ends of each auger segment). A sensor or sensors to sense paving material height may be provided between the inner-most and out-most portions of each auger segment (i.e., between the first and second ends of each auger segment) in addition or alternatively to sensors at one or more of the first and second ends of each auger segment. FIG. 1, for instance, illustrates the third sensor 158 provided to sense paving material height associated with outer-most portions of the second auger segment 135 and the fourth auger segment 138, and the fourth sensor 160 provided to sense paving material height associated with inner-most portions of the first auger segment 134 and the third auger segment 137.

According to one or more embodiments of the disclosed subject matter, each of the sensors of the first set of sensors 150 and the second set of sensors 152 is configurable to sense a same height or different heights of paving material (including same or different paving height ranges) provided at a corresponding portion of the auger system 130. For example, the second sensor 156 and the third sensor 158 may be configured to sense whether a height or height range "H1" of paving material provided at a corresponding portion of the front side 144 of the auger system 130 is achieved. In another example, the second sensor 156 may be configured to sense whether the height or height range "H1" of paving material provided at a corresponding portion of the auger system 130 is achieved, and the third sensor 158 may be configured to sense whether a height or height range "H2" of paving material provided at a corresponding portion of the auger system 130 is achieved.

Each sensor of the first and second sets of sensors 150, 152 may be one of a sonic sensor, a paddle or rotary sensor, and an infrared sensor. Further, all of the sensors may be of a same type or configuration of sensor, infrared, sonic or paddle, for instance, or, alternatively, at least one of the sensors may be different in type or configuration as compared to the other sensors, per first and second sets of sensors 150, 152, or per the collective sensors of the first and second sets of sensors 150, 152. For example, the first set of sensors 150 and the second set of sensors 152 may include at least one sonic or infrared sensor and at least one paddle sensor. Further, in one or more embodiments of the present disclosure, the first set of sensors 150 and the second set of sensors 152 may include sonic and/or infrared sensors to sense paving material height at the auger system 130, for instance, at a front side thereof for respective ends of the auger system 130, and paddle sensors for the sensors between the ends of the auger system 130, or vice versa. As another example, the first set of sensors 150 and the second set of sensors 152 may all be either sonic sensors, paddle sensors, or infrared sensors.

Generally speaking, a paddle sensor according to various embodiments of the disclosed subject matter may be adapted to float across a top of paving material at a corresponding location in front of the screed 142, for instance, in front of the auger system 130. A position of a paddle or rotor of the paddle sensor can change in correspondence with the height of the paving material during operation of the paving machine 100, indicating the height of the paving material based on a prior calibration of the paddle or rotor of the paddle sensor.

For embodiments where a sonic or infrared sensor or sensors are implemented, such sensor(s) can be oriented perpendicular to flow or movement of the paving material. For instance, sonic or infrared sensors to sense material height at ends of the auger system 130 can be arranged so as to send signals such that they impact the paving material flow in a perpendicular nature. Further, additionally or alternatively, in one or more embodiments of the disclosed subject matter one or more of the sonic or infrared sensors may be oriented so as to send pulses directly downward. For example, in one or more embodiments of the disclosed subject matter, sensors other than those at ends of the auger system 130 can be sonic or infrared sensors that are oriented so as to send signals directly downward.

The sensors of the first set of sensors 150 and the second set of sensors 152 can be configurable and re-configurable to sense a particular height or height range of paving material at a corresponding portion or area in front of the front side 144 of the screed 142, for instance, at a front side or central axle of the auger system 130, to detect whether the paving material height is at a pre-defined height (within tolerance) or within a pre-defined height range, or, conversely, whether the paving material height is not at the pre-defined height (including an in-tolerance allotment) or not within the pre-defined height range.

The paving machine 100 may further include an operator station 162 for accommodating an operator to operate the paving machine 100. The operator station 162 may include operation control components and be part of a paving machine control system 102 (discussed in more detail below relative to FIG. 3), where the operation control components can include a control panel 164, a display panel 168, etc. The control panel 164 can be in communication with control circuitry 166 of the paving machine 100 to control operations of the paving machine 100. The operations of the paving machine 100 may include, but not limited to, controlling opening and closing of the hopper 108, controlling speed or rate of movement of the conveyor system 112 (including stopping movement), controlling speed or rate of movement of the auger system 130 (including stopping movement), controlling operation of the screed 142, and controlling speed or rate of movement of the paving machine 100 as a whole (including stopping movement).

The control circuitry 166 can receive signals from the sensing circuitry 122 disposed at the conveyor system 112 based on the sensed height of the paving material 110 at the entrance of the conveyor system 112, for instance, at an entrance of a tunnel of the conveyor system 112. The control circuitry 166 can also receive signals from the first set of sensors 150 and the second set of sensors 152 based on the sensed height of the paving material at various portions in front of the screed 142, for instance, directly in front of the auger system 130. The signals from the sensing circuitry 122, the first set sensors 150 and the second set of sensors 152, based on the sensed height of the paving material, are communicated to the control circuitry 166 of the paving machine 100 to control operations of the paving machine 100, including one or more of controlling speed or rate of movement of the conveyor system 112 (including increasing or decreasing speed and stopping movement), controlling speed or rate of movement of the auger system 130 (including increasing or decreasing speed and stopping movement), and controlling speed or rate of movement of the paving machine 100 as a whole (including increasing or decreasing speed and stopping movement).

Optionally, the signals from the first set of sensors 150 may be received as a composite signal representative of a detected paving material height condition in front of the screed 142, for instance, directly in front of the auger system 130. Similarly, the signals from the second set of sensors 152 may be received as a composite signal representative of a detected paving material height condition in front of the screed 142, for instance, directly in front of the auger system 130. In one or more embodiments, based on the signals from one or more of the sensing circuitry 122, the first set of sensors 150 and the second set of sensors 152, the control circuitry 166 may provide instruction to the operator through the display panel 168 at the control panel 164 of the operator station 162. Further, the control circuitry 166, based on the signals from one or more of the sensing circuitry 122, the first set of sensors 150 and the second set of sensors 152, may automatically control operations of the paving machine 100, including one or more of controlling speed or rate of movement of the conveyor system 112 (including increasing or decreasing speed and stopping movement), controlling speed or rate of movement of the auger system 130 (including increasing or decreasing speed and stopping movement), and controlling speed or rate of movement of the paving machine 100 as a whole (including increasing or decreasing speed and stopping movement).

Figure 2:
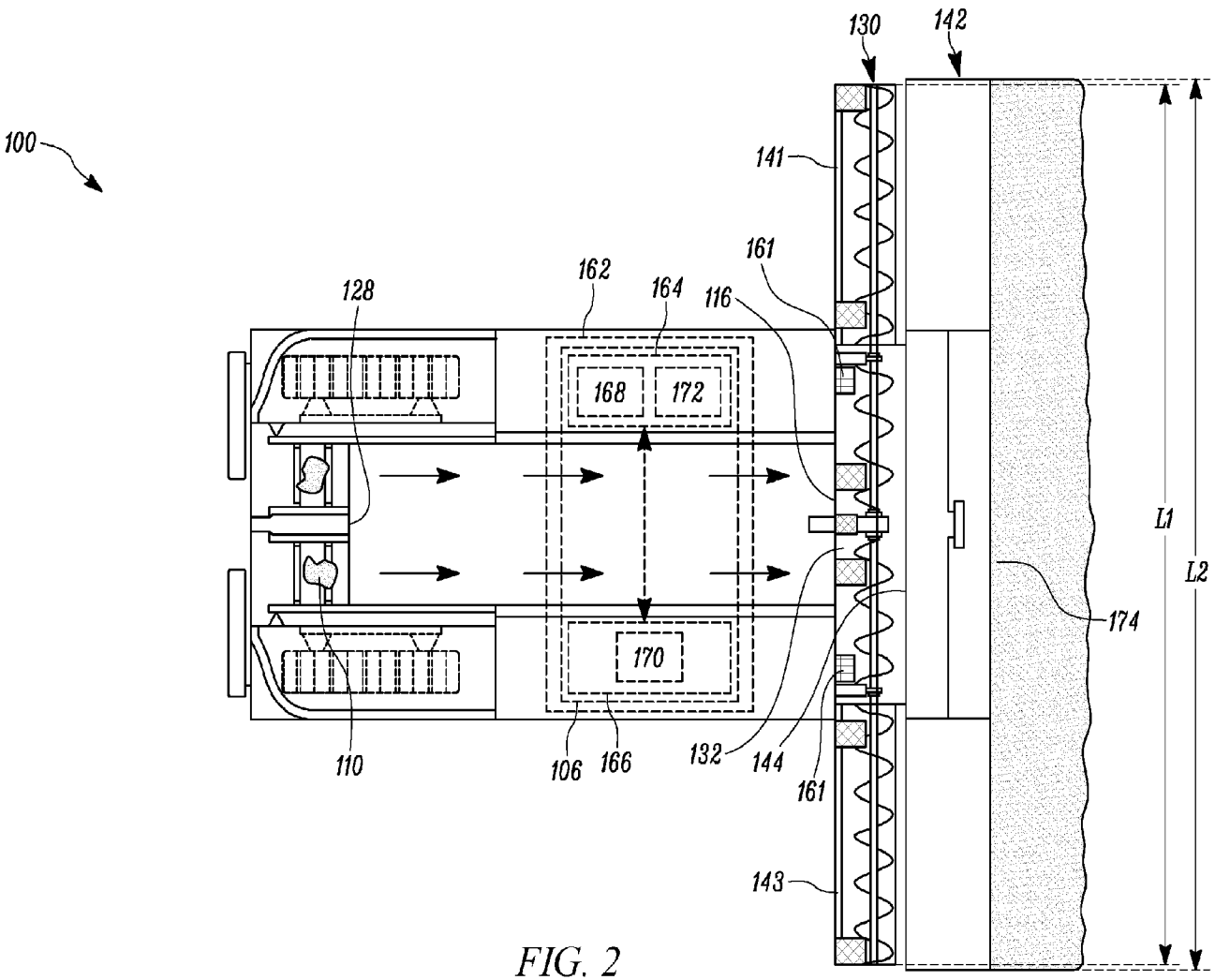
FIG. 2 is a planar diagrammatic representation of the paving machine or movable paving system, according to one or more embodiments of the present disclosure.

FIG. 2 illustrates a planar diagrammatic representation of the paving machine 100 including at least one fifth sensor 161 disposed adjacent an outer-most portion of the first auger segment 134 and the third auger segment 137, according to one or more embodiments of the present disclosure, to sense paving material height at corresponding portions or areas of the auger system 130. The fifth sensor 161 can send to the control circuitry 166 signals regarding sensed paving material height at corresponding portions or areas in front of the first auger segment 134 and/or at the central axle of the auger system 130 at the first auger segment 134 and at corresponding portions or areas in front of the third auger segment 137 and/or at the central axle of the auger system 130 at the second auger segment 137. Thus, the fifth sensor 161 can identify, or can send signals to the control circuitry 166 so the control circuitry 166 can identify, paving material height-related conditions, such as underflow or overflow height-related conditions prior to the paving material reaching the second auger segment 135 and/or the fourth auger segment 138, respectively.

As noted above, the screed 142 includes the front side 144 facing the auger system 130. Further, the screed 142 has a length 'L1,' which can be an extended length from an original or non-wide-width paving length. The length 'L1' may be at least as long as a total length 'L2' of the auger system 130 in the first direction 139 and the second direction 140. In one or more embodiments, the length 'L1' of the screed 142 is greater than or equal to two times of retracted or non-extended length of the screed 142. Optionally, the length of the screed L1 may be greater than a length L2 of the auger system 130 (diagrammatically represented in FIG. 2).

Figure 3:
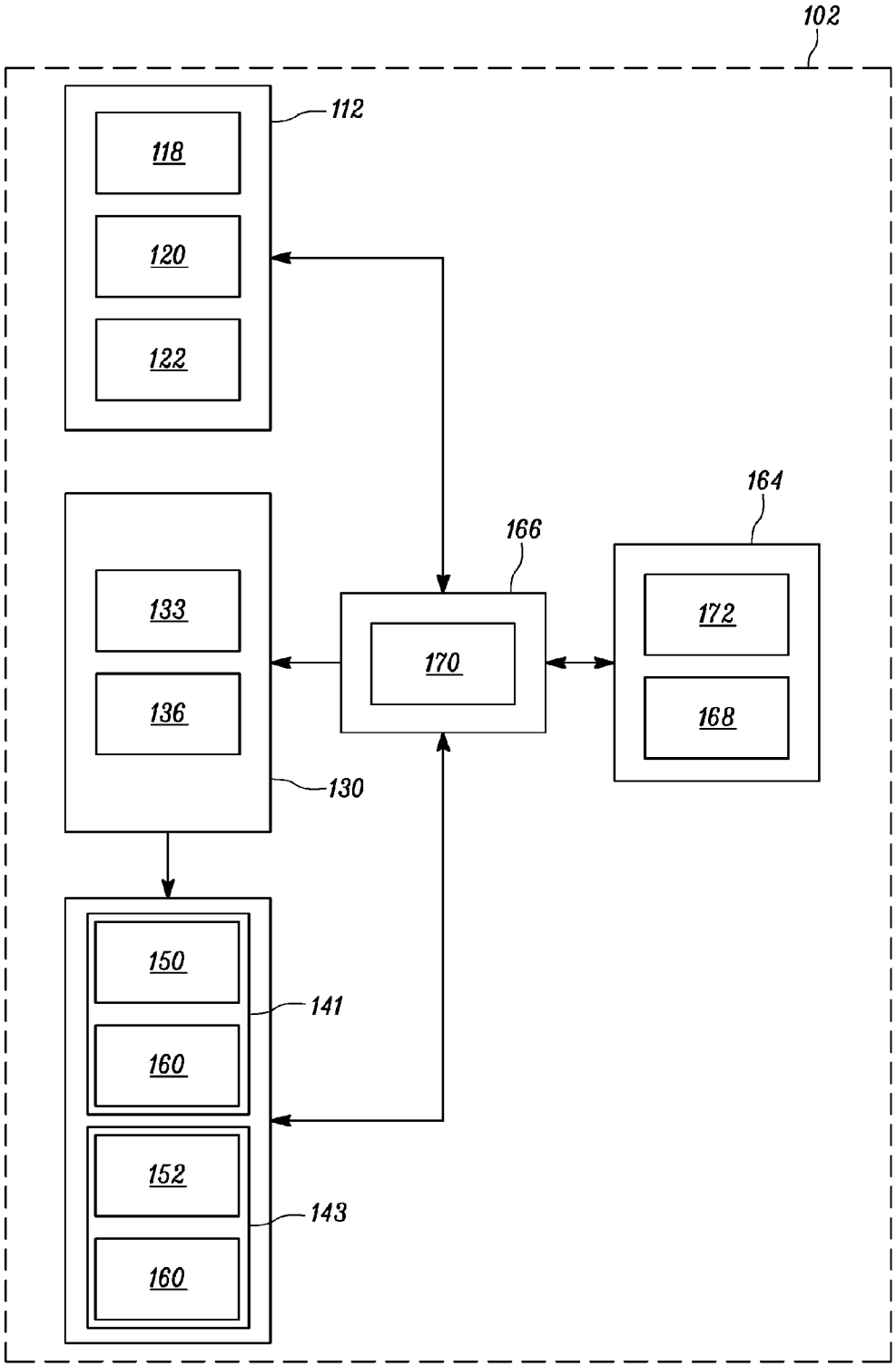
FIG. 3 is a block diagram of a paving control system, according to one or more embodiments of the present disclosure.

FIG. 3 illustrates a schematic block diagram of a paving machine control system 102 of the paving machine 100, according to one or more embodiments of the present disclosure.

The conveyor system 112 or control portions thereof, may be part of the paving machine control system 102, and can include the first conveyor 118 and the second conveyor 120 and is connected to a controller 170 of the control circuitry 166. The sensing circuitry 122 is also connected to the controller 170 of the control circuitry 166.

As noted above, the first sensor 124 and the second sensor 126 of the sensing circuitry 122 are configured to sense the height of the paving material 110 at the entrance conveyor system 112, for instance, at an entrance to the tunnel 128, and generate respective signals indicative of the height of the paving material 110. The signals indicative of the height of the paving material 110 can be communicated to the controller 170 of the control circuitry 166. The controller 170 is configured to compare the sensed height of the paving material 110 with a first pre-set threshold height (or threshold height range) of the paving material 110. The term first pre-set threshold height (or threshold height range) as used herein refers to a height or height range of the paving material 110 required at the entrance of the tunnel 128 for paving a desired road thickness and surface.

If the controller 170 determines that the sensed paving material height is less than the first pre-set threshold height or height range, then the controller 170 may identify the paving material height condition as an "underflow condition." or an anticipated underflow condition. Generally speaking, the term "underflow condition" in the context of the conveyor system 112 may refer to a condition of the paving material 110 flow or transport in which less volume of the paving material 110 is provided at an entrance to the conveyor system 112. On the other hand, if the controller 170 determines that the sensed paving material height is more than the first pre-set threshold height or height range, the controller 170 may identify the paving material height condition as an "overflow condition" or an anticipated overflow condition. The term "overflow condition" in the context of the conveyor system 112 may refer to a condition of the paving material 110 flow or transport in which more volume of the paving material 110 provided at the entrance to the conveyor system 112.

Optionally, one or more additional pre-set threshold height or height ranges may be implemented. For example, if the paving material height is sensed to be at the first pre-set threshold height or height range, the controller may output an alert to the paving machine operator via the display panel 168 and/or the speaker 172. The alert may indicate to the paving machine operator that the sensed paving material height is not at an underflow or overflow condition, but if remedial action to adjust the paving material height is not taken, the paving material height will or will likely become an underflow or overflow condition. Additionally or alternatively, the controller 170 can automatically control the speed of the conveyor system 112, increase or decrease, responsive to the determined paving material flow condition.

If the paving material height is sensed to be at another pre-set threshold height or height range, the controller 170 may output a different alert to the paving machine operator via the display panel 168 and/or the speaker 172 specifying that the paving material height is at an underflow or overflow condition. Additionally or optionally, the controller 170 can automatically control the speed of the conveyor system 112, increase, decrease or stop based on the determined paving material flow condition and its severity, responsive to the determined paving material flow condition.

Thus, the controller 170, based on the determined paving material height condition, can control the speed or rate of movement of the conveyor system 112 or portions thereof, such as first conveyor 118 and/or second conveyor 120. That is, the controller 170 can provide an instruction to the first conveyor 118 and the second conveyor 120 independently either to increase or decrease (including stopping) the speed or rate of movement of the first conveyor 118 and the second conveyor 120. For example, if the controller 170 determines that the paving material height condition is an underflow condition at the first conveyor 118, then the controller 170 can communicate an instruction to the first conveyor 118 to increase the speed or rate of movement of the first conveyor 118 to increase volume of the paving material 110 transported on the first conveyor 118. Accordingly, a determined underflow condition can be rectified at an entrance to the conveyor system 112, for instance at an entrance to the tunnel 128.

As noted above, the paving machine 100 further includes the auger system 130 adjacent to the second end 116 of the conveyor system 112 and the first and second mainframe extensions 141, 143. Paving material 110 transported through the conveyor system 112 is transferred from the second end 116 of the conveyor system 112 to the auger system 130 at a controllable rate. The auger system 130 including the first set of augers 133 and the second set of augers 136 can be in communication with the controller 170 of the control circuitry 166 such that the controller can individually control the speed at which the first set of augers 133 operates and the speed at which the second set of augers 136 operates. The controller 170 can increase or decrease the speed or rate of movement of the first set of augers 133 and the second set of augers 136 based on respective signals from first and second sets of sensors 150, 152, as noted above. Likewise, as noted above, the controller 170 can control the amount of paving material provided to the auger system 130 by controlling the speed of the conveyor system 112 supplying the paving material based on signals from the first and second sets of sensors 150, 152.

The first set of sensors 150, the second set of sensors 152, the fourth sensor 160, and the fifth sensor 161 are configured to be in communication with the controller 170 of the control circuitry 166. The first set of sensors 150, the second set of sensors 152, the fourth sensor 160, and the fifth sensor 161 can generate signals based on the heights of the paving material 110 at various locations at before the front side 144 of the screed 142, for instance, directly in front of the auger system 130. The signals generated by the first set of sensors 150, the second set of sensors 152, the fourth sensor 160, and the fifth sensor 161 can be communicated to the controller 170 of the control circuitry 166, and the controller 170, upon receiving the signals, can determine the paving material height condition at each of the locations at the auger system 130 by comparing the sensed heights with a pre-set threshold height or height threshold range. The term second pre-set threshold height or height range in the context of the paving material height associated with the auger system 130 may refer to a height of the paving material 110 required at the auger system 130, and consequently the front side 144 of the screed 142, to pave a desired road thickness and surface.

If the controller 170 determines that the sensed paving height at a particular location or location is less than the pre-set threshold height or height range, the controller 170 can identify the paving material height condition as an "underflow condition," in which case the controller 170 can control the speed of one or more of the conveyor system 112 and the associated first and second auger set or sets 133, 136. If the controller 170 determines that the sensed paving height is more than the pre-set threshold height or height condition, the controller 170 may identify the paving material height condition as an "overflow condition," in which case the controller 170 can control the speed of one or more of the conveyor system 112 and the associated first and second auger set or sets 133, 136.

In some embodiments, the controller 170 is configured to increase or decrease the rate of movement of one or more of the first set of augers 133, responsive to the signals from the first set of sensors 150, and based on a determined underflow condition or the overflow condition, respectively. In some embodiments, the controller 170 is configured to increase or decrease the rate of movement of the second set of augers 136, responsive to signals from the second set of sensors 152, based on a determined underflow condition or the overflow condition, respectively.

The controller 170 can also communicate with the control panel 164 of the paving machine 100. Based on determined conditions during the paving process, such as the underflow condition or an overflow condition, the controller 170 can provide a display at the display panel 168 to provide details of the location at which the underflow or overflow conditions are determined. In addition, the controller 170 may cause output of the alert (or alerts) the speaker 172 based on the determined paving material height condition ahead of the front side 144 of the screed 142.

INDUSTRIAL APPLICABILITY

Figure 4:
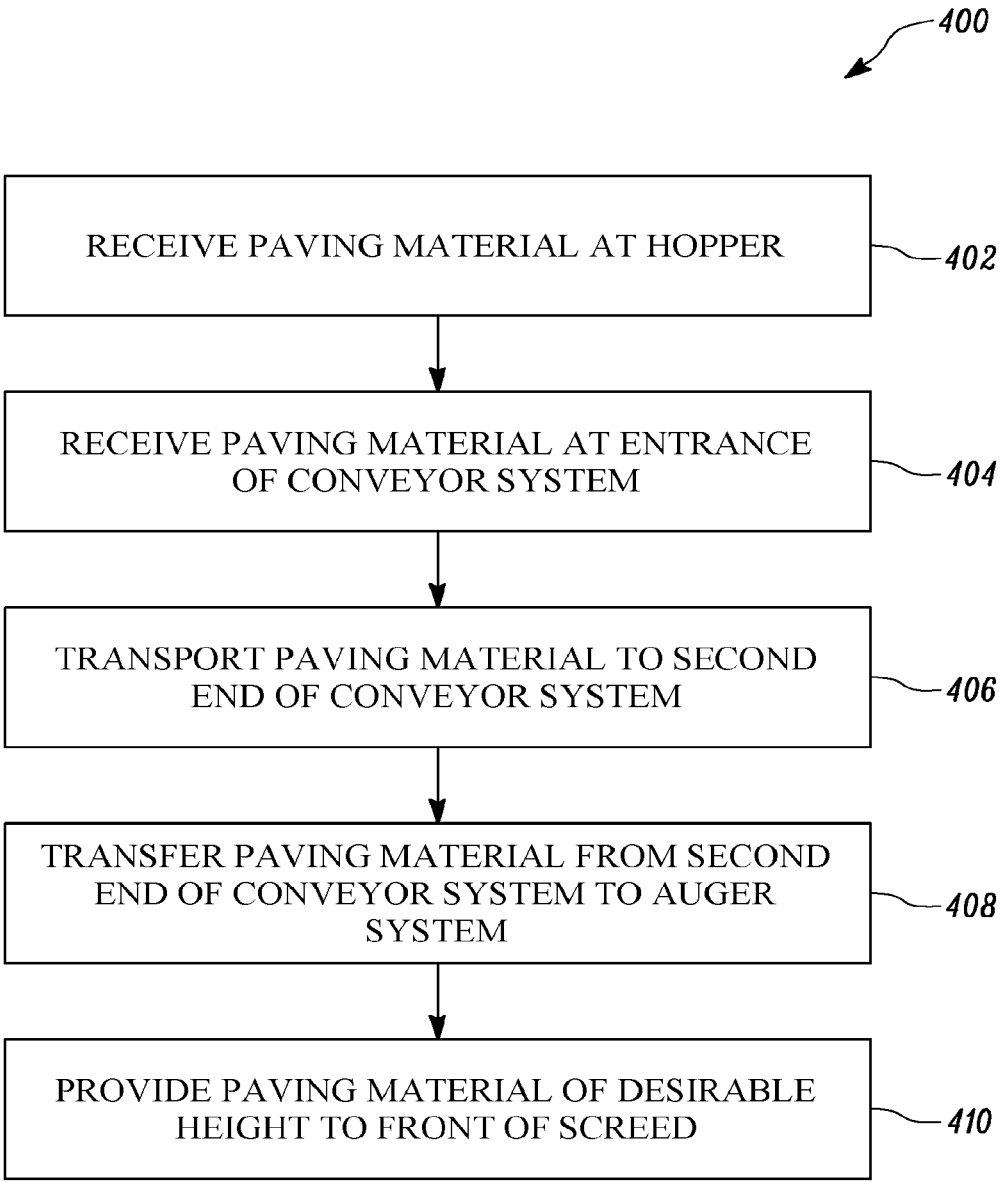
FIG. 4 is a flowchart of a method of providing paving material to a paving surface, according to one or more embodiments of the present disclosure.

FIG. 4 illustrates a flowchart of a method 400 for controlling movement of paving material along the paving machine 100, according to one or more embodiments of the present disclosure.

At step 402, the paving material 110 is received at the hopper 108 of the paving machine 100.

At step 404, the paving material 110 is received from the hopper 108 at an entrance to a conveyor system of the paving machine, such as the entrance of the tunnel 128 of the conveyor system 112.

At step 406, the paving material 110 is transported to the second end 116 of the conveyor system 112, which is opposite a first end 114 of the conveyor system 112 at which the paving material 110 is provided.

At step 408, the paving material is transferred from the second end 116 of the conveyor system 112 to the auger system 130, particularly to a deposit site or area at a middle portion 132 of the auger system 132.

At step 410, the auger system 130 can be operated to move the paving material 110 outwardly from the middle portion 132 in the first direction 139 and/or the second direction 140 such that paving material is provided along the entire front side 144 of the screed 142 at a desired, predetermined height or within a predetermined height range. As noted above, the screed 142 can compress the paving material provided along its front side 144 to produce a post-screed pavement material area 174, which may be further processed by other paving equipment or machinery.

Figure 5:
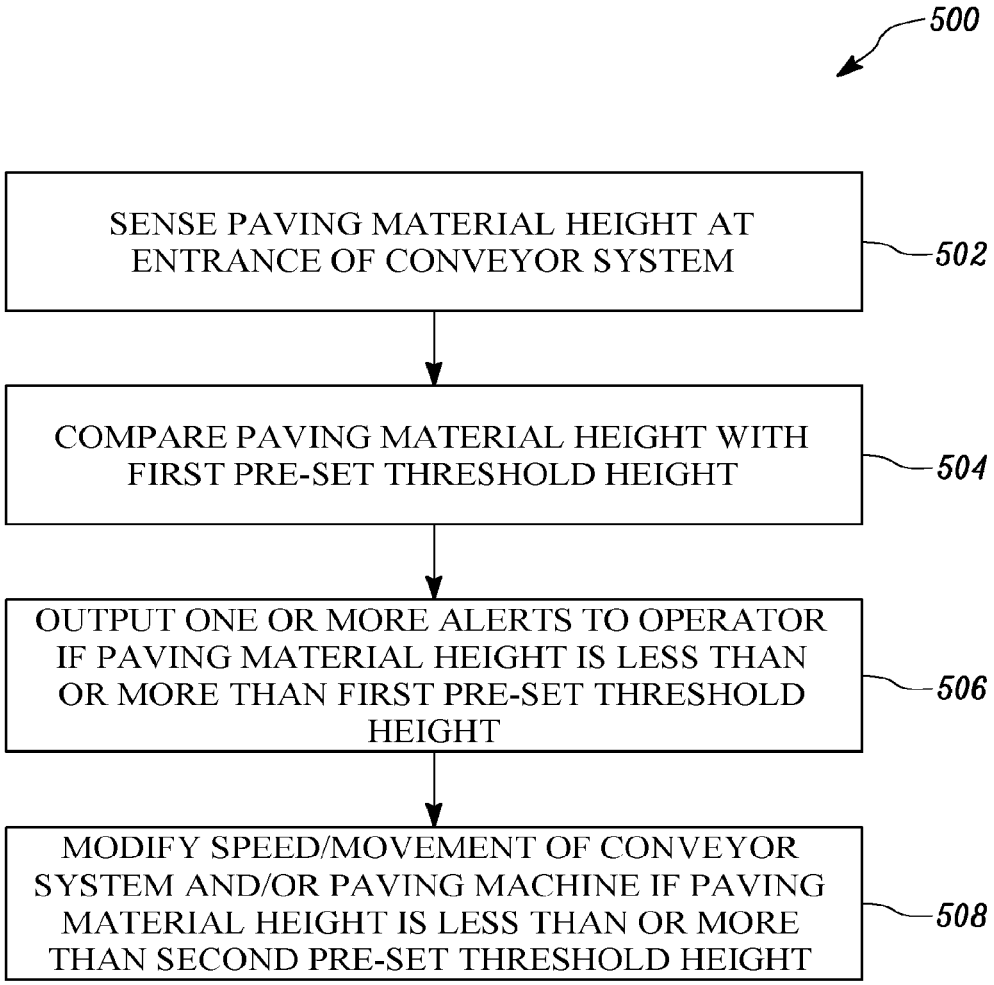
FIG. 5 is a flowchart of a method for sensing paving material height of paving material supplied to a conveyor system of a paving machine, according to one or more embodiments of the present disclosure.

FIG. 5 illustrates a flowchart for a method 500 for sensing the height of the paving material 110 at the conveyor system 112, particularly and entryway to the conveyor system 112, according to one or more embodiments of the present disclosure.

At step 502, the height of the paving material 110 can be sensed, for instance, at the entrance of the tunnel 128 of the conveyor system 112, using the sensing circuitry 122. The first sensor 124 and the second sensor 126 can generate signals representative of the sensed height, and the generated signals can be communicated to the controller 170 of the control circuitry 166.

At step 504, after receiving the signals from the first sensor 124 and the second sensor 126, the controller 170 can compare the sensed height of the paving material 110 with a first pre-set threshold height or height range. If the controller 170 determines that the sensed height of the paving material 110 is less than or more than the first pre-set threshold height or height range, the controller 170 can determine or identify that the paving material height represents either the underflow condition or the overflow condition, respectively.

At step 506, the controller 170 can communicate a signal to the control panel 164 of the paving machine 100, for instance, to output an alert or alerts to the operator if the paving material height condition is determined as approaching or anticipated to reach the underflow condition or the overflow condition, or, alternatively determined as being in either the underflow or overflow condition. Optionally, the speed of the conveyor system 112 and/or auger system 130 may be changed responsive to the controller determining that the sensed paving material height is not at the pre-set threshold height or not within the pre-set threshold height range.

At step 508, if the controller 170 determines that the sensed height of the paving material 110 is less than or more than a second pre-set threshold height or height range, the controller 170 can determine or identify that the paving material height represents either an underflow condition or the overflow condition, respectively. In this regard, the controller 170 can communicate a signal to the control panel 164 of the paving machine 100, for instance, to output an alert or alerts to the operator if the paving material height condition is determined as being in either the underflow or overflow condition. Further, the speed of the conveyor system 112 and/or auger system 130 may be changed responsive (i.e., automatically) to the controller determining that the sensed paving material height is in the underflow or overflow condition. Optionally, movement of one or more of the conveyor system 112 and the auger system 130 may be stopped responsive (i.e., automatically) to the controller determining that the sensed paving material height is in the underflow or overflow condition. Additionally, optionally, the speed/movement of the paving machine 100 may be modified based on the determined paving material height condition, for instance, slowed down or even stopped.

Figure 6:
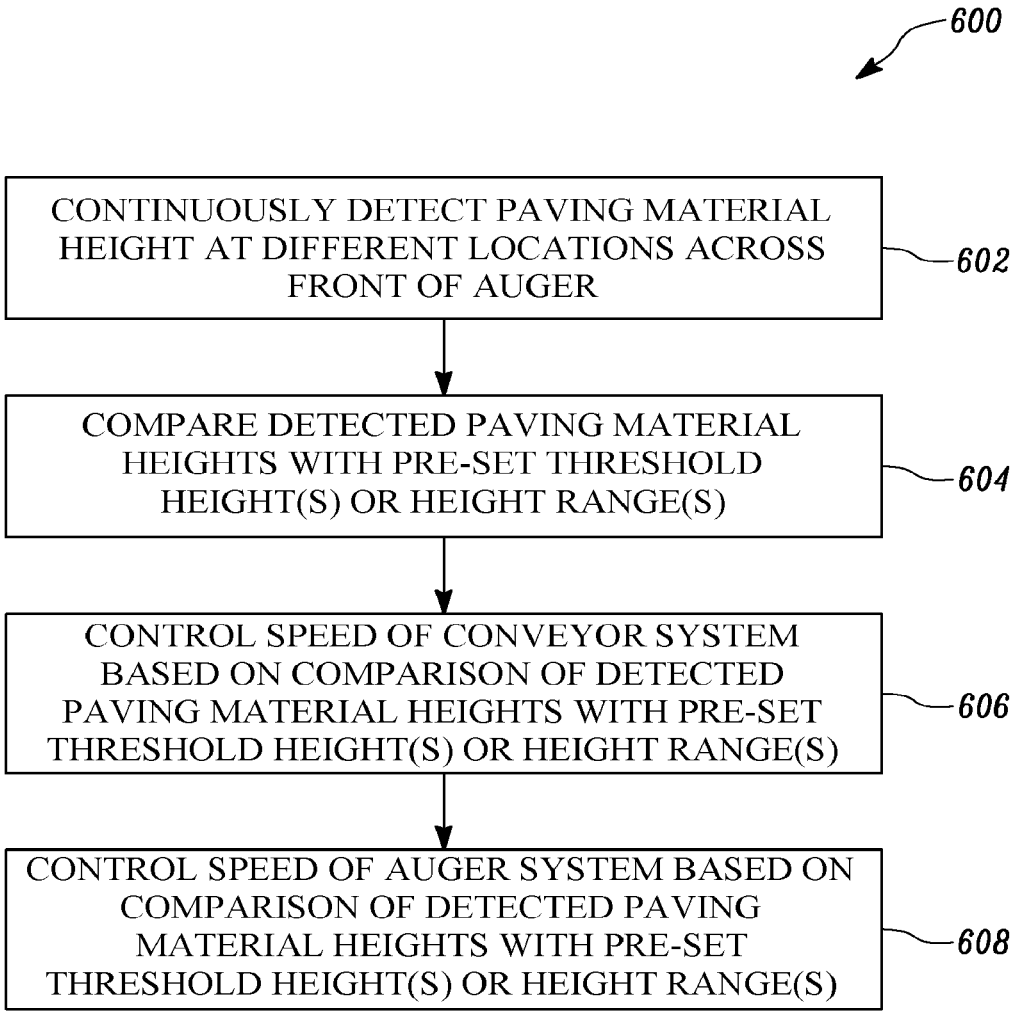
FIG. 6 is a flowchart of a method for sensing paving material height of paving material at an auger system of a paving machine, according to one or more embodiments of the present disclosure.

FIG. 6 illustrates a flowchart of a method 600 for sensing the height of the paving material 110 before the front side 144 of the screed 142, according to one or more embodiments of the present disclosure.

At step 602, the height of the paving material essentially along the entire auger system 130, for instance, directly in front of the auger segments of the auger system 130, can be continuously sensed at different locations using a plurality of spaced-apart sensors of independent sensors and/or sensor sets, such as the first sensor set 150, the second sensor set 152, the fourth sensor 160, and the fifth sensor 161 discussed above. The sensed paving material heights can be communicated to the controller 170, for instance, by way of signals received from the sensors arranged in front of and/or over the auger system 130 or the auger segments of the auger system 130, such as the first sensor set 150, the second sensor set 152, the fourth sensor 160, and the fifth sensor 161 discussed above.

At step 604, the controller 170 can compare the sensed heights of the paving material with pre-set threshold heights or height ranges to determine whether the amount of paving material at the particular location is acceptable or unacceptable.

At step 606, responsive to the comparison in step 604, the controller can control the speed of the conveyor system 112 according to whether the paving material at a particular location or locations is acceptable or unacceptable, and according the manner in which the paving material at a particular location or locations is acceptable or unacceptable. For instance, the controller may temporarily increase the speed of the conveyor system 112 to provide additional paving material to the auger system 130 in an effort to correct or prevent an inadequate amount of paving material from propagating further along the auger system 130 and thus the front side 144 of the screed 142.

At step 608, responsive to the comparison in step 604, the controller can control the speed of the auger system 130, including the speed of the first set of augers 133 and the second set of augers 136, according to whether the paving material at a particular location or locations is acceptable or unacceptable, and according the manner in which the paving material at a particular location or locations is acceptable or unacceptable. For instance, the controller may temporarily increase the speed of one of the first and second sets of augers 133, 136 to provide additional paving material in an effort to correct or prevent an inadequate amount of paving material from propagating further along the auger system 130 and thus the front side 144 of the screed 142.

Thus, the paving machine 100 according to embodiments of the disclosed subject matter can quickly and accurately detect and correct potential or actual flow issues or potential or actual delivery issues of paving material. Further, the paving machine 100 according to embodiments of the disclosed subject matter can prevent or lessen uneven or inconsistent distribution of paving material 110 by the auger system 130 at the front side 144 of the screed 142 and correct the paving material potential or actual flow or delivery issues upon or prior to initial deposit of the paving material 110 from the conveyor system 112 to the auger system 130. As discussed above, a plurality of paving material height sensors along the length of the auger system 130 can be implemented to automatically detect and correct the amount of paving material, ultimately provided to the front side 144 of the screed.

Software logic can be used to control the rate of change of the conveyor system 112 and/or the auger system 130 speed to properly and pro-actively refill an auger chamber of the auger system 130 without creating an overflow condition or underflow condition. A user interface may be provided in the operator station 162, for instance, to calibrate the sensors placed in front of the screed 142. The operator can "calibrate" the sensors in front of the screed 142 through the user interface to "zero-out" all of the sensors at once or the sensors individually, to then set each of the sensors to sense a desired paving material height. Alternatively, the sensors may not need to be "zeroed-out" and may merely be set by the operator at a desired paving material height.

A configurable dead band around that zero point of each of the sensors may be used by processing circuitry to notify the operator, via the user interface or the control panel 164, for instance, when one or multiple sensors have fallen out of range, indicating that height of the paving material 110 around the auger system 130 is no longer consistent at all points.

An alert by way of an audio through the speaker 172 may be provided to the operator, for instance, on a primary user interface, when the sensor detects an overflow or underflow condition, or anticipated overflow or underflow condition. Additionally or alternatively, the paving machine 100 may automatically stop movement of the paving machine 100 when the overflow or the underflow condition exists. Optionally, this feature may be disabled by the operator. Optionally, this feature may cause the operator to have to reset the propel condition once the paving material 110 flow condition has been rectified.

Multiple programmable/configurable paving material flow level thresholds may be set (and re-configured) for each paving material flow condition. For example, a first paving material height threshold may indicate to the operator, for example, on the control panel 164, that height of the paving material 110 at the entrance of the conveyor system 112 is approaching a buffer zone for the underflow or overflow condition, a second material paving height threshold may indicate to the operator, for example on the control panel 164 and via an audible alarm, that the height of the paving material 110 at the entrance of the conveyor system 112 is in the buffer zone for the underflow or overflow condition, and a third material paving height threshold may represent that height of the paving material 110 at the entrance of the conveyor system 112 is in an underflow or overflow condition and cause automatic stoppage of movement of the paving machine 100 (i.e., not to shut down the paving machine 100, but just the forward movement).

Optionally, the rate of the conveyor system 112 may be modified (i.e., increased or decreased) automatically based on the detected paving material 110 level at the entrance. For example, if an underflow condition is detected the conveyor system 112 may be slowed down or even stopped automatically. Optionally, speed or movement of the paving machine 100 may be modified, for instance, reduced or stopped, automatically based on the detected paving material 110 level at the entrance.

While aspects of the present disclosure have been particularly shown and described with reference to the embodiments above, it will be understood by those skilled in the art that various additional embodiments may be contemplated by the modification of the disclosed machines, systems and methods without departing from the scope of what is disclosed. Such embodiments should be understood to fall within the scope of the present disclosure as determined based upon the claims and any equivalents thereof.

What is claimed is:

1. A movable paving system for wide-width paving comprising:

a conveyor system having a first end to receive a paving material from a hopper and a second end opposite to the first end to output the paving material received at the first end, the conveyor system having a first conveyor and a second conveyor parallel to the first conveyor, the first conveyor and the second conveyor being independently controllable;

an auger system arranged adjacent the second end of the conveyor system to receive the paving material from the conveyor system at a middle portion of the auger system, the auger system including a first set of augers extending in a first direction from the middle portion of the auger system, and a second set of augers extending in a second direction opposite to the first direction from the middle portion of the auger system, the first set of augers being controllable independently from the second set of augers;

a screed having a front side facing the auger system and a length at least as long as a total length of the auger system in the first and second directions, the length of the screed being greater than or equal to two times a retracted width of the screed;

a first mainframe extension in front of the auger system, extending in the first direction and projecting out from a left side of a mainframe of the paving system;

a second mainframe extension in front of the auger system, extending in the second direction and projecting out from a right side of the mainframe of the paving system;

sensing circuitry arranged at an entrance of a tunnel of the conveyor system, at the first end, the sensing circuitry being configured to sense a height of the paving material on the conveyor system received from the hopper;

a first set of three or more sensors, different from the sensing circuitry arranged at the entrance of the tunnel of the conveyor system, the first set of three or more sensors being arranged in spaced relationship from each other, wherein each sensor is configured to sense a height of the paving material at a front side along the auger system at a corresponding different portion of a left side of the auger system, and wherein at least one sensor is arranged on the first mainframe extension;

a second set of three or more sensors, different from the sensing circuitry arranged at the entrance of the tunnel of the conveyor system, the second set of three or more sensors being arranged in spaced relationship from each other, wherein each sensor is configured to sense a height of the paving material at the front side along the auger system at a corresponding different portion of a right side of the auger system, and wherein at least one sensor is arranged on the second mainframe extension; and control circuitry configured to control rate of movement of one or more of the first conveyor and the second conveyor based on a signal received from the sensing circuitry at the entrance of the tunnel of the conveyor system, control rate of movement of the first conveyor based on signals from the first set of three or more sensors, control rate of movement of the first set of augers based on the signals from the first set of three or more sensors, control rate of movement of the second conveyor based on signals from the second set of three or more sensors, and control rate of movement of the second set of augers based on the signals from the second set of three or more sensors.

2. The movable paving system of claim 1, wherein the first set of three or more sensors and the second set of three or more sensors are symmetrically disposed with respect to the middle portion of the auger system, and wherein each of the first set of three or more sensors and the second set of three or more sensors includes:

a first sensor arranged to sense a height of the paving material at the front side of the auger system where the paving material is received from the conveyor system, a second sensor arranged to sense a height of paving material at a corresponding end of the front side of the auger system, and a third sensor arranged to sense a height of paving material at the front side of the auger system between where the first and second sensors sense.

3. The movable paving system of claim 1, wherein the first set of augers comprises a first auger segment and second auger segment; wherein the second set of augers comprises a third auger segment and a fourth auger segment; wherein each of the first and second sets of three or more sensors includes a fourth sensor arranged to sense a height of paving material at the front side of the auger system between where the first and third sensors sense; and wherein the fourth sensor of the first set of sensors is arranged adjacent to the second auger segment on the first mainframe extension and the fourth sensor of the second set of sensors is arranged adjacent to the fourth auger segment on the second mainframe extension.

4. The movable paving system of claim 1, wherein, for each of the first and second sets of three or more sensors, a first sensor is disposed at a bearing joint of an inner-most auger of the respective first and second sets of augers.

5. The movable paving system of claim 1, wherein each of the sensors of the first and second sets of three or more sensors is configurable to sense a same or a different height of the paving material.

6. The movable paving system of claim 1, wherein the control circuitry is configured to increase or decrease the rate of movement of one or more of the first conveyor and the first set of augers responsive to received signals from the first set of three or more sensors indicating detection of an underflow condition or an overflow condition, respectively, at the front side of the auger system, respectively, and increase or decrease the rate of movement of one or more of the second conveyor and the second set of augers responsive to received signals from the second set of three or more sensors indicating detection of an underflow condition or an overflow condition, respectively, at the front of the auger system, respectively.

7. The movable paving system of claim 2, wherein the first set of augers comprises a first auger segment and second auger segment; wherein the second set of augers comprises a third auger segment and a fourth auger segment; wherein the first set of three or more sensors and the second set of three or more sensors comprises a fourth sensor disposed between the second sensor and the third sensor; wherein the first set of three or more sensors comprises a fifth sensor disposed adjacent to an outer most portion of the first auger segment; and wherein the second set of three or more sensors comprises a fifth sensor adjacent to an outermost portion of the third auger segment.

8. A movable wide-width paving machine comprising:

a conveyor having a first end to receive paving material and a second end opposite the first end to output the paving material received at the first end;

an auger system disposed adjacent the second end of the conveyor to receive the paving material from the conveyor at a deposit site and having a plurality of augers extending outward in a line from the deposit site;

a first mainframe extension extending outward in a first direction beyond a frame of the paving machine;

a second mainframe extension extending outward in a second direction opposite the first direction beyond the frame of the paving machine;

a plurality of sensors configured to sense paving material height at different locations along a front side of the plurality of augers, one of the plurality of sensors being configured to detect paving material height at a location at the front side of the plurality of augers between the deposit site and an end of the auger system opposite the deposit site, two of the plurality of sensors being arranged on the first mainframe extension, two of the plurality of sensors being arranged on the second mainframe extension, and wherein sensing areas of the plurality of sensors are confined to predefined sensing areas at the front side of the auger system that do not overlap; and control circuitry configured to receive signals from the plurality of sensors indicative of the detected paving material heights, and increase or decrease a speed of one or more conveying portions of the conveyor and the plurality of augers of the auger system, responsive to a signal from said one of the sensors indicating an underflow condition or an overflow condition of the paving material, respectively, at the location at the front side of the plurality of augers between the deposit site and the end of the auger system opposite the deposit site.

9. The movable wide-width paving machine of claim 8, wherein a total number of the plurality of sensors is at least one more than a total number of the plurality of augers.

10. The movable wide-width paving machine of claim 8, wherein the increase or decrease of the speed of the one or more conveying portions of the conveyor and the plurality of augers is responsive to signals from all of the sensors of the plurality.

11. The movable wide-width paving machine of claim 8, wherein the increase or decrease of the speed of one or more conveying portions of the conveyor and the plurality of augers is responsive to a signal from at least one additional sensor of the plurality of sensors, other than said one sensor, indicating an underflow condition or an overflow condition of the paving material, respectively, at one of the different locations at the front side of the auger system other than the location associated with said one sensor.

12. The movable wide-width paving machine of claim 8, wherein the control circuitry is configured to increase or decrease the speed of one or more conveying portions of the conveyor and the plurality of augers responsive to the signal from said one of the sensors indicating the underflow condition or the overflow condition such that an overflow condition or an underflow condition is precluded at the deposit site.

13. The movable wide-width paving machine of claim 8, wherein the control circuitry is configured to slow down or stop one or more conveying portions of the conveyor responsive to a signal from sensing circuitry, different from the plurality of sensors, indicating that the height of a paving material height of paving material at an entrance to the conveyor is in the underflow condition or is approaching the underflow condition.

14. The movable paving machine of claim 8, wherein the control circuitry is configured to cause output of an alert responsive to a signal from sensing circuitry, which is different from the plurality of sensors, indicating that a paving material height of paving material at an entrance to the conveyor is in the underflow condition or is approaching the underflow condition.

15. A method of wide-width paving comprising:

receiving, at a controller, signals from a plurality of sensors representing detected pre-set paving material height conditions at different, spaced-apart locations along an entire front side of an auger system, including a first composite signal representing a first pre-set paving material height condition at the front of the auger system at a first position on a first side of a deposit site of the paving material from a conveyor system, on a first mainframe extension between the deposit site and a first end of the auger system, and a second composite signal representing a second pre-set paving material height condition at the front of the auger system at a second position on a second side of the deposit site opposite the first side, on a second mainframe extension between the deposit site and a second end of the auger system;

selectively increasing or decreasing, using the controller, a rate of movement of a first set of augers of the auger system on the first side of the deposit site responsive to the first composite signal representing the first pre-set paving material height condition of either an underflow or overflow condition; and selectively increasing or decreasing, using the controller, a rate of movement of a second set of augers of the auger system on the second side of the deposit site responsive to the second composite signal representing the second pre-set paving material height condition of either an underflow or overflow condition.

16. The method of claim 15, further comprising selectively increasing or decreasing, using the controller, a rate of movement of one or more conveyors of the conveyor system responsive to one of the composite signal and the second composite signal.

17. The method of claim 15, wherein said selectively increasing or decreasing the rate of movement of the first set of augers is to a first rate of movement, and selectively increasing or decreasing the rate of movement of the second set of augers is to a second rate of movement, the first rate of movement and the second rate of movement being different.

18. The method of claim 15, wherein said selectively increasing or decreasing the rate of movement of the first set of augers is based on all signals of the plurality of sensors associated with the first side of the auger system, and said selectively increasing or decreasing the rate of movement of the second set of augers is based on all signals of the plurality of sensors associated with the second side of the auger system.

19. The method of claim 15, further comprising selectively adjusting, using the controller, a rate of movement of the conveyor system responsive to a signal from a first sensing unit and a second sensing unit of sensing circuitry, different from the plurality of sensors, indicating that a paving material height at an entrance to the conveyor system is in an underflow condition or an overflow condition or is within a predetermined amount away from an underflow or overflow condition.

20. The method of claim 19, further comprising outputting an alert responsive to a signal from one of a first sensing unit and a second sensing unit of sensing circuitry, different from the plurality of sensors, indicating that a paving height of paving material at an entrance to the conveyor system is in an underflow condition or an overflow condition or is approaching an underflow condition or an overflow condition.

* * * * *